US009333143B2

(12) United States Patent
Weber et al.

(10) Patent No.: US 9,333,143 B2
(45) Date of Patent: May 10, 2016

(54) EXERCISE DEVICE AND METHOD OF USE

(71) Applicants: Eric Michael Weber, Lighthouse Point, FL (US); Glenna Day Weber, Lighthouse Point, FL (US)

(72) Inventors: Eric Michael Weber, Lighthouse Point, FL (US); Glenna Day Weber, Lighthouse Point, FL (US)

( * ) Notice: Subject to any disclaimer, the term of this patent is extended or adjusted under 35 U.S.C. 154(b) by 94 days.

(21) Appl. No.: 14/190,380

(22) Filed: Feb. 26, 2014

(65) Prior Publication Data

US 2014/0179499 A1 Jun. 26, 2014

Related U.S. Application Data

(63) Continuation-in-part of application No. 13/023,576, filed on Feb. 9, 2011, now abandoned.

(51) Int. Cl.

| | |
|---|---|
| ***A63B 21/00*** | (2006.01) |
| ***A61H 1/02*** | (2006.01) |
| *A63B 23/00* | (2006.01) |

(52) U.S. Cl.

CPC ..... *A61H 1/0274* (2013.01); *A61H 1/02* (2013.01); *A61H 1/0292* (2013.01); *A61H 2201/0153* (2013.01); *A61H 2201/0161* (2013.01); *A63B 2023/006* (2013.01)

(58) Field of Classification Search

CPC ..... A63B 21/00; A63B 21/00178; A63B 21/00189; A63B 21/002; A63B 23/00; A63B 2023/006; A63B 20/0085; A63B 20/002; A63B 20/0023; A63B 20/4037; A63B 20/4039; A61H 1/02; A61H 1/0274; A61H 1/0292; A61H 2201/0153; A61H 2201/0161

USPC ..... 482/91–92, 131, 148, 907; 119/702, 119/707–711; D30/160

See application file for complete search history.

(56) References Cited

U.S. PATENT DOCUMENTS

| | | | | |
|---|---|---|---|---|
| 3,595,578 | A * | 7/1971 | Burcenski | A63B 67/06 273/343 |
| 3,643,947 | A * | 2/1972 | Collins | A63F 9/00 273/109 |
| 5,120,051 | A * | 6/1992 | Greenberg | A63B 69/0086 482/148 |
| 5,329,881 | A * | 7/1994 | O'Rourke | A01K 15/026 119/709 |
| 5,993,377 | A * | 11/1999 | Hartwig | A61F 7/12 600/38 |
| 6,402,580 | B1 * | 6/2002 | Coleman | A23G 3/50 426/104 |
| 6,723,031 | B1 * | 4/2004 | Wild | A63B 23/20 128/842 |
| D743,115 | S * | 11/2015 | Byrne | D30/160 |
| 2004/0185951 | A1 * | 9/2004 | Coletti | A63B 69/3655 473/139 |
| 2005/0017455 | A1 * | 1/2005 | Long | A63B 43/007 273/343 |
| 2006/0234841 | A1 * | 10/2006 | Koch | A63B 21/0004 482/91 |
| 2007/0062461 | A1 * | 3/2007 | Lubeck | A01K 15/026 119/709 |
| 2011/0277695 | A1 * | 11/2011 | Smith | A01K 15/026 119/707 |
| 2013/0047931 | A1 * | 2/2013 | Lai | A01K 15/026 119/710 |
| 2014/0299070 | A1 * | 10/2014 | Harrington | A01K 15/025 119/707 |

* cited by examiner

*Primary Examiner* — Oren Ginsberg
*Assistant Examiner* — Garrett Atkinson
(74) *Attorney, Agent, or Firm* — The Concept Law Group, P.A.; Erin A. Martin; Yongae Jun

(57) ABSTRACT

An exercise device for stretching a user's muscles is disclosed. The exercise device includes a pliable substantially non-resilient cord having a length between a first end and a second end, and a plurality of ball shaped handles positioned along the length of the pliable substantially non-resilient cord. Each of the plurality of ball shaped handles is fixedly attached to the pliable substantially non-resilient cord with a plurality of handle fasteners.

18 Claims, 6 Drawing Sheets

EXERCISE DEVICE AND METHOD OF USE

CROSS-REFERENCE TO RELATED APPLICATION

This application claims priority to U.S. Non-Provisional Patent Application No. 13/023,576 filed Feb. 9, 2011, the entirety of which is incorporated by reference.

FIELD OF THE INVENTION

The present invention relates generally to an exercise device and method of use, and more particularly relates to an exercise device, which aids in proper stretching of muscles and other body parts.

BACKGROUND OF THE INVENTION

It is well-known that proper stretching techniques before and after engaging in a physical activity are important to prevent injury and promote physical fitness. Proper stretching also assists in obtaining the correct form for particular physical activities, such as sports. For example, medical experts have found that stretching prior to engaging in a game of golf helps promote a fluid, full golf swing, which can improve performance during the game.

Some known stretching devices and methods include those that are fixed in a single position and are designed to be affixed or attached to a wall or another rigid structure. These devices are not portable or foldable for compact storage and transport. Accordingly, these devices provide limited usefulness, particularly in situations where a user desires to stretch at an outdoor location or where the user desires the ability to use the stretching device at multiple locations.

Some prior-art stretching devices utilize one or more moving parts, such as pulleys, mechanical devices, pivoting components, sliding mechanisms, and the like. It is well-known in the mechanical arts that moving parts tend to wear and break over time more quickly than non-moving parts. Accordingly, such stretching devices tend to require more maintenance and upkeep, and, if broken, will require replacement, resulting in the inability to use the device until the replacement occurs. Additionally, stretching devices with moving parts are typically more expensive and complicated to manufacture, as well as, more complicated to use. For example, if pivoting components were used in the stretching device, this would typically require pivot holes to be made in the device along with pivot pins. Thus, the device would need to be sufficiently thick to form the pivot holes and receive the pivoting pins. This would limit the choices of materials that could be used and require a more complicated design. The device would need to be sufficiently rigid for the pivoting structure to retain its shape and configuration during use.

Other stretching devices include rigid tools such as poles, sticks, and rods. These stretching devices have limited portability and limited usefulness. They do not fold into a more compact form for convenient storage and transport. The stretches that can be utilized with these devices are very limited because of the rigid, non-pliable structure.

Elastic or resilient bands are known, but are primarily designed for strength training, not stretching. Accordingly, the resistance provided by resilient bands are not conducive to gentle, safe stretching. Resilient bands also promote poor stretching techniques as they tend to bounce and jerk, which can cause injury. This bounce effect can lead to unintended overextended stretching, erratic tension application, and can force an individual to exert more force than is proper for the stretch. The risk of injury is increased for individuals with limited flexibility and strength, such as the elderly.

Many prior-art stretching devices include a pair of gripping handles, one for each hand of the user. The pair of gripping handles is usually fixed at a location on the body of the device. This configuration limits use of the device to stretches that can be performed by the user gripping the device at the particular location required by the fixed placement of the pair of gripping handles. Additionally, the fixed location of the gripping handles is not a one-size-fits-all solution, as the location will be optimal for some individuals, yet uncomfortable for other individuals who have a different arm span.

Some prior-art stretching devices utilize loops as handles, which may inhibit proper tension against the user's gripping hands. Also, loop handles limit orientation of the user's hands.

Therefore, there remains a need in the art for a stretching device that is portable and compact; durable; easy and inexpensive to manufacture; easy to use, store, and transport; promotes safe and proper stretching techniques; and provides flexibility of use for multiple arm-span lengths and multiple types of stretches, as discussed above.

SUMMARY OF THE INVENTION

The invention provides an exercise device and method that overcomes the hereinafore-mentioned disadvantages of the heretofore-known devices and methods of this general type and that provides an exercise device having a plurality of ergonomic handles fixedly attached to a pliable non-flexible cord for assisting individuals with using proper and safe stretching techniques.

With the foregoing and other objects in view, there is provided, in accordance with the invention, an exercise device including a pliable substantially non-resilient cord having a length between a first end and a second end; a plurality of ball shaped handles supported by the pliable substantially non-resilient cord and positioned along the length of the pliable substantially non-resilient cord; and a plurality of handle fasteners adapted to fixedly attach the plurality of ball shaped handles to the pliable substantially non-resilient cord; wherein a first one of the plurality of ball shaped handles is positioned at the first end of the pliable substantially non-resilient cord; a second one of the plurality of ball shaped handles is positioned at the second end of the pliable substantially non-resilient cord; and a third one of the plurality of ball shaped handles is positioned between the first end and the second end of the pliable substantially non-resilient cord.

In accordance with another feature, an embodiment of the present invention includes a fourth one of the plurality of ball shaped handles is positioned between the first end and the second end of the pliable substantially non-resilient cord.

In accordance with a further feature of the present invention, at least one of the plurality of ball shaped handles is adapted to be selectively positioned along the length of the pliable substantially non-resilient cord.

In accordance with a further feature of the present invention, at least one of the plurality of handle fasteners is a knot.

In accordance with a further feature of the present invention, at least one of the plurality of handle fasteners is a clamp.

In accordance with a further feature of the present invention, each of the plurality of handle fasteners defines a through-hole that the pliable substantially non-resilient cord passes through.

In accordance with a further feature of the present invention, each of the plurality of handle fasteners is fixedly attached along the length of the pliable substantially non-resilient cord by at least one knot formed of a sufficient size to abut an opening of the through-hole, while not passing through the opening.

In accordance with a further feature of the present invention, the length of the pliable substantially non-resilient cord is an arm span length of a user.

In accordance with a further feature of the present invention, the pliable substantially non-resilient cord is comprised of a rope.

In accordance with a further feature of the present invention, the plurality of ball shaped handles is comprised of golf balls.

In accordance with another feature, an embodiment of the present invention includes an exercise kit, comprising an exercise device including a pliable substantially non-resilient cord having a length between a first end and a second end, and a plurality of markings on a surface of the pliable substantially non-resilient cord. The exercise device further includes a plurality of ball shaped handles supported by the pliable substantially non-resilient cord and positioned along the length of the pliable substantially non-resilient cord; a plurality of handle fasteners adapted to fixedly attach the plurality of ball shaped handles to the pliable substantially non-resilient cord; and a handle adjustment chart including a list of different user measurements along with an identification of a corresponding one of the plurality of markings; wherein a first one of the plurality of ball shaped handles is positioned at the first end of the pliable substantially non-resilient cord; a second one of the plurality of ball shaped handles is positioned at the second end of the pliable substantially non-resilient cord; a third one of the plurality of ball shaped handles is positioned between the first end and the second end of the pliable substantially non-resilient cord; and at least one of the plurality of ball shaped handles is adapted to be selectively positioned along the length of the pliable substantially non-resilient cord.

In accordance with another feature of the present invention, the kit further includes instructions for performing at least one stretching exercise with the exercise device.

In accordance with yet another feature, the user measurements comprise at least one of different heights and different arm span lengths.

In accordance with a further feature of the present invention, the length of the pliable substantially non-resilient cord is about 60 inches to about 85 inches.

In accordance with the present invention, an embodiment of the present invention includes a method for performing a stretching exercise to stretch a muscle, comprising steps of obtaining an exercise device, the exercise device including a pliable substantially non-resilient cord having a length between a first end and a second end; a plurality of ball shaped handles supported by the pliable substantially non-resilient cord and positioned along the length of the pliable substantially non-resilient cord; and a plurality of handle fasteners adapted to fixedly attach the plurality of ball shaped handles to the pliable substantially non-resilient cord; wherein a first one of the plurality of ball shaped handles is positioned at the first end of the pliable substantially non-resilient cord; a second one of the plurality of ball shaped handles is positioned at the second end of the pliable substantially non-resilient cord; and a third one of the plurality of ball shaped handles is positioned between the first end and the second end of the pliable substantially non-resilient cord. The method further includes gripping with a user's hand at least one of the plurality of ball shaped handles and, while gripping the at least one of the plurality of ball shaped handles with the user's hand, applying a force to the exercise device that stretches the muscle.

In accordance with yet another feature, the method includes gripping with the user's hands two of the plurality of ball shaped handles and pulling each of the two of the plurality of ball shaped handles in different directions.

In accordance with another feature, the method further includes wrapping the pliable substantially non-resilient cord around a fixed object, prior to applying the force.

Although the invention is illustrated and described herein as embodied in an exercise device, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
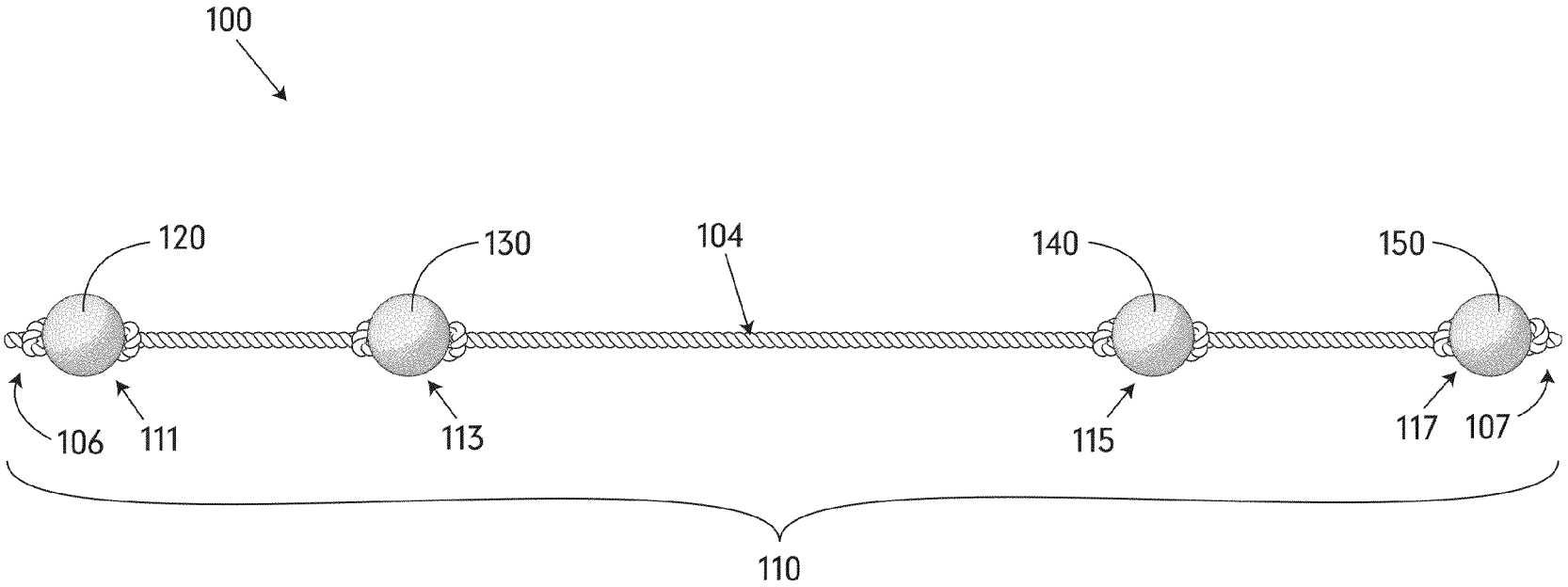
FIG. 1 is a side elevational view of an exemplary implementation of an exercise device, in accordance with the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient exercise device for stretching a user's muscles. Embodiments of the invention provide a substantially non-resilient cord and a plurality of handles fastened along the length of the cord. In addition, embodiments of the invention provide an adjustable handle whose distance from an end handle can be selectively adjusted by the user in accordance with the user's arm span or height.

Referring now to FIG. 1, one embodiment of the present invention is shown in a side elevation view. FIG. 1 shows several advantageous features of the present invention, but, as will be described below, the invention can be provided in several shapes, sizes, combinations of features and components, and varying numbers and functions of the components. The first example of an exercise device 100, as shown in FIG. 1, includes a substantially non-resilient cord 104. Coupled to the non-resilient cord 104, along a length 110 of the cord 104, is a first end handle 120, a second end handle 150, a first intermediate handle 130, and a second intermediate handle 140.

The non-resilient cord 104 is a slender length of pliable material that can be used to support the handles 120, 130, 140, 150. The term "pliable," as used herein, is intended to indicate any object capable of bending repeatedly without breaking. The cord 104 can be made of any non-resilient material, as long as it allows the user to apply a user-selected amount of pulling force or tension to the cord 104, without the cord 104 bouncing or springing back after the pulling force is released. As such, the material is considered "substantially non-resilient" if it inhibits or prevents the cord from springing back after it is released by a user. This eliminates the risk of injury caused by resilient exercise bands. It advantageously promotes safe and proper stretching, by enabling the user to determine and regulate the amount of force placed on the user's body during stretching. An example of a cord 104 exhibiting this non-resilient characteristic is a rope, as shown in FIG. 1; however, it is understood that the present invention may include cords 104 comprised of other non-resilient materials, as described above.

The substantially non-resilient cord 104 can be configured having a diameter or thickness adapted for ergonomic gripping by the user in the case of stretches in which the user grips the cord 104, instead of, or along with, the handles 120, 130, 140, 150. In some embodiments, the thickness and color of the cord 104 can be selected by the user in accordance with her personal preference.

The substantially non-resilient cord 104 can be any length. In a preferred embodiment, the substantially non-resilient cord 104 is a sufficient length that the handles 120, 130, 140, 150 are positioned along the cord 104 such that the user can grasp one of the end handles 120, 150 and the farther intermediate handles 130, 140, while raising the individual's arms at an acute angle relative to the ground (see FIG. 11). The substantially non-resilient cord 104 is more preferably a length that corresponds to an arm span length of the user. A length of the substantially non-resilient cord 104 of from about 60 inches to about 85 inches corresponds to the arm span length of most individuals. This preferred length is optimal for use with a wide variety of stretches, including stretches in which the cord 104 is wrapped around a fixed object (see FIG. 12).

Figure 2:
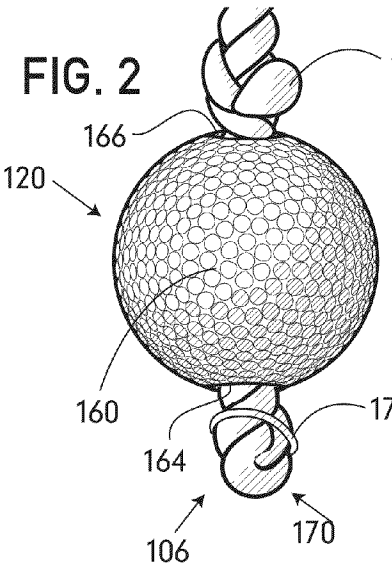
FIG. 2 is an enlarged side elevational view of an end handle of the exercise device, originally introduced in FIG. 1.
Figure 3:
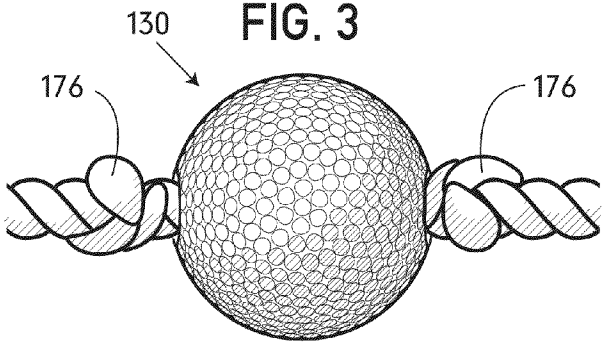
FIG. 3 is an enlarged side elevational view of an intermediate handle of the exercise device, originally introduced in FIG. 1.
Figure 4:
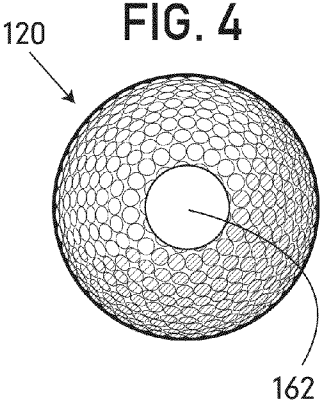
FIG. 4 is an enlarged front elevational view of the handle of the exercise device that is removed from a rope length, as originally introduced in FIG. 1.

Referring now primarily to FIGS. 2-4, the handles 120, 130, 140, 150 will be described with reference to the first end handle 120, for brevity; however, it is understood that the description also applies to the other handles 130, 140, 150, which are shown as having an identical structure, unless otherwise indicated. The exemplary handle 120 is shown in the form of a rigid, ball-shaped object. In particular, the exemplary handle 120 is shown as a golf ball. It is understood that the handles 120, 130, 140, 150 can be any object that is adapted to be held or operated with a human hand and configured for attachment along the length of the substantially non-resilient cord 104. The handle 120 is preferably an ergonomic handle, intended to provide optimum comfort and avoid injury when used as a gripping surface during stretching exercises. In one embodiment, the handle 120 may be a solid or a hollow sphere. In other embodiment, the handle 120 may be other shapes and configurations as well, such as, for example, cylindrical, bulbous, semi-circular, rectilinear, or any other shape and configuration provided that it is ergonomic, as described above. In some embodiments, the size, color, material, and style of the handle 120 can be selected by the user in accordance with his or her body type, or personal preference. The handle 120 can be made of any material.

Preferably the material is a low-cost, readily available, yet durable material, such as a polymer or polymer blend. A surface 160 of the handle 120 can be smooth or rough. The exemplary handle 120 is provided with a dimpled surface, akin to a golf ball. A rough surface can advantageously provide an amount of friction to assist the user in maintaining her grip on the handle 120, while the user is applying a pulling force during a stretch.

The handle 120 is shown in FIGS. 2-4 with a passage 162. The body of the handle 120 defines the passage 162, through which the substantially non-resilient cord 104 may pass through. The handle passage 162 is a through-hole including a first opening 164 and a second opening 166 at opposing ends of the passage 162. The passage 162 can be formed by drilling a bore through the handle 120. The openings 164, 166 are preferably sized and configured to engage handle fasteners, such that the handle fasteners do not also pass through the openings 164, 166 into the passage 160, as will be described in more detail below. Said another way, the handle fasteners are of a diameter greater than a diameter of at least one of the first and second openings 164, 166. Although the exemplary handles 120, 130, 140, 150 are coupled to the substantially non-resilient cord 104 by receiving the substantially non-resilient cord 104 into the respective handle passage 162. It can be appreciated that the handles 120, 130, 140, 150 may also be coupled to the substantially non-resilient cord 104 by other apparatuses and methods, provided that the handles 120, 130, 140, 150 are secured to the substantially non-resilient cord 104 in a spaced apart manner, providing a plurality of fixed ergonomic gripping surfaces for engaging in a variety of exercise stretches.

Referring now primarily to FIGS. 2 and 4, the handles 120, 130, 140, 150 are fastened securely along the length 110 of the substantially non-resilient cord 104. The end handles 120 and 150 are fastened to the substantially non-resilient cord 104 with an end fastener 170 and the intermediate handles 130 and 140 are fastened to the substantially non-resilient cord 104 with an intermediate fastener 176. The exemplary intermediate fastener 176 is shown as a knot; formed by looping the substantially non-resilient cord 104, inserting a free end of the cord 104 into the loop, and pulling opposite ends of the cord 104 in opposing directions until the knot is formed, as is generally known. The formed knot 176 is of a sufficient size to abut the handle openings 164, 166, while not passing through the openings 164, 166 in order to secure the corresponding handles 120, 130, 140, 150 to the substantially non-resilient cord 104 by preventing the handles 120, 130, 140, 150 from sliding along the handle length 110. The exemplary end fastener 176 is shown as formed by folding an end 106 of the substantially non-resilient cord 104 inwardly and using a clamp 172 to fasten the cord end 106. As with the knot, the clamp 172 is of a sufficient size so as not to pass through the openings 164, 166, in order to secure the corresponding end handles 120, 150 to the substantially non-resilient cord 104 by preventing the end handles 120, 150 from sliding along the handle length 110. It is understood that the fasteners 170, 176 can be any type of fastener, provided that it secures the handles 120, 130, 140, 150 to the substantially non-resilient cord 104 in a spaced apart manner along the length 110 of the cord 104. The fasteners 170, 176 are preferably adapted to secure the handles 120, 130, 140, 150 to the substantially non-resilient cord 104 in a fixed manner, such that the handles 120, 130, 140, 150 do not pivot or slide longitudinally along the length of the cord during use.

Referring now primarily to FIG. 1, the first end handle 120 and the second end handle 150 are coupled to the substantially non-resilient cord 104 at a first position 111 and a fourth position 117, respectively, along the cord length 110. The first 111 and fourth positions 117 are preferably at opposing ends of the substantially non-resilient cord 104. The first and second intermediate handles 130, 140 are coupled to the substantially non-resilient cord 104 at a second position 113 and third position 115, respectively, along the cord length 110. The second and third positions 113 and 115 are between the first and fourth end positions 111 and 117. This configuration of four spaced apart handles 120, 130, 140, 150 provides a plurality of handle gripping locations, which facilitates a wider range of stretches than would be possible with only two handle gripping locations, as is taught by the prior-art. The handles 120, 130, 140, 150 can be equally spaced apart, or be spaced apart at varying distances. In some embodiments the spacing between the handles 120, 130, 140, 150 can be adjusted by the user, before use, in accordance with the user's arm span, or height, as will be described in more detail below.

Figure 5:
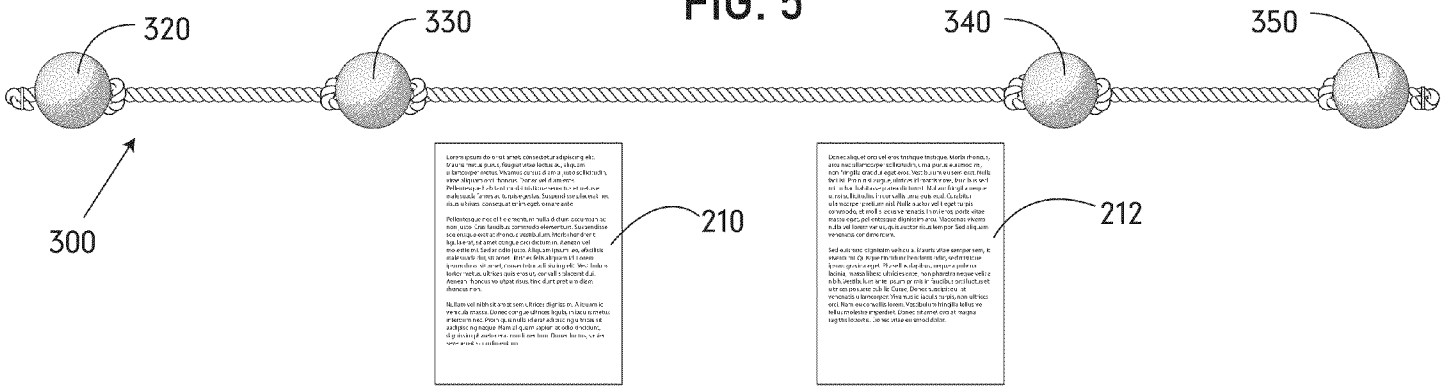
FIG. 5 is a perspective view of an exemplary implementation of the exercise device in the form of a kit, including a height chart.

Referring now primarily to FIG. 5, an exercise device kit 200 is illustrated. The kit 200 includes a handle adjusting exercise device 300 and a handle adjustment chart 210, for use in guiding the user in adjusting a handle position in accordance with the user's body measurements, such as the user's arm span length or height. The kit 200 may also include instructions 212 that informs the user on how to adjust the handle position and teaches the user of the proper use of the exercise device 300 to engage in specific stretching exercises recommended for use with the device 300.

Figure 6:
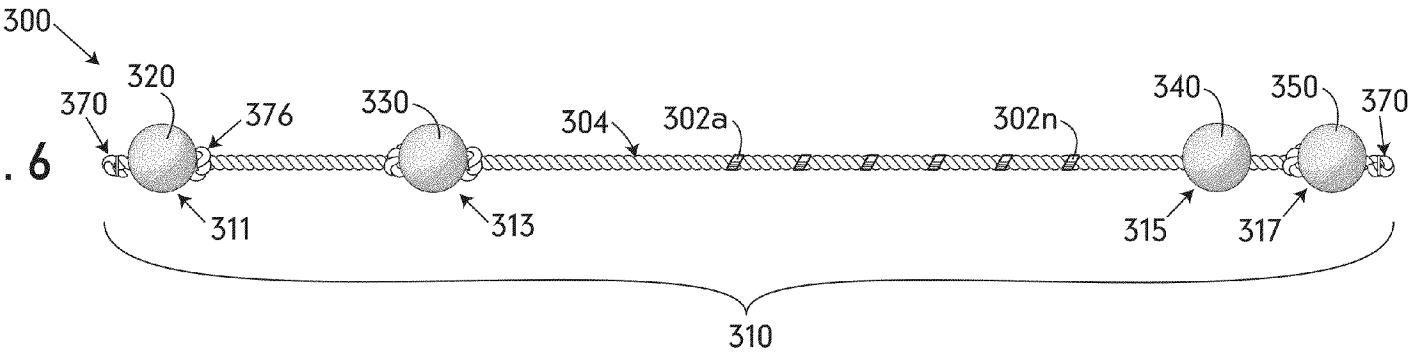
FIG. 6 is a side elevational view of another exemplary implementation of an exercise device, in accordance with the present invention, illustrating an adjustable handle.

An alternative embodiment of the exercise device of the present invention is presented in FIG. 6, as the handle adjusting exercise device 300. The exercise device 300 is similar to the exercise device 100, except that the exercise device 300 includes a handle adjustment feature, as will be described in more detail below.

The exercise device 300 includes a substantially non-resilient cord 304. Coupled to the substantially non-resilient cord 304, along a length 310 of the cord 304, are a first end handle 320, a second end handle 350, a first intermediate handle 330, and a second intermediate handle 340. The end handles 320 and 350 are fastened to the substantially non-resilient cord 304 with an end fastener 370 and the intermediate handles 330 and 350 are fastened to the substantially non-resilient cord 304 with an intermediate fastener 376. The first end handle 320 and the second end handle 350 are coupled to the substantially non-resilient cord 304 at a first position 311 and a fourth position 317, respectively, along the cord length 310. The first and fourth positions 311, 317 are preferably at opposing ends of the substantially non-resilient cord 304. The first and second intermediate handles 330, 340 are coupled to the substantially non-resilient cord 304 at a second position 313 and third position 315, respectively, along the cord length 310. The first intermediate handle 330 can be fastened at the second position 313. The second intermediate handle 340, however, can be the adjustable handle. Accordingly, the second intermediate handle 340 can be slideably supported by the substantially non-resilient cord 304, provided to the user initially without fasteners 376 to allow the user to slideably adjust the position of the handle 340 along the cord length 310, prior to fastening.

The substantially non-resilient cord 304 includes a plurality of markings 302*a-n* to indicate various locations along the cord length 310 that the adjustable handle 340 can be positioned at. The number of markings 302 between "a" and "n" can be any number. The number of markings 302*a-n* preferably corresponds to the number of positions listed in the handle adjustment chart 210 (FIG. 5). The handle adjustment chart 210 includes a list of user measurements, such as user's height, along with an identification of a distinguishing marking 302 on the cord 304 that corresponds to a selected listed height. The distinguishing markings 302 can be differentiated in any manner, such as, for example, using different colors or symbols, provided that the user can associate a particular marking 302 with the selected listed height. The markings 302 can be provided in any known method, such as for example, by painting or printing different colors or symbols on the cord 304, or by adhering a distinguishing sticker on the cord 304. The markings 302 may also incorporate a notched surface shaped to receive a protruding portion of the adjustable handle 340.

Figure 7:
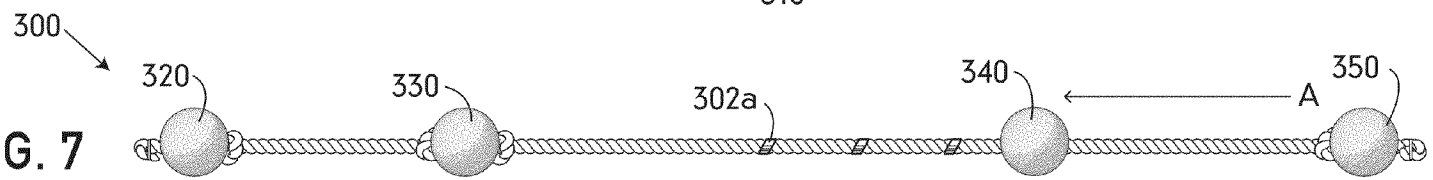
FIG. 7 is side elevational view of the exemplary implementation of the exercise device, originally introduced in FIG. 6, illustrating movement of an intermediary handle to a user-selected position along a length of a rope of the exercise device.
Figure 8:
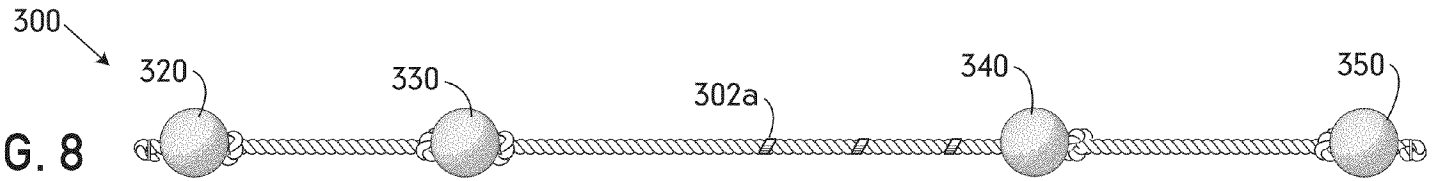
FIG. 8 is a side elevational view of the exercise device, originally introduced in FIG. 6, illustrating creation of a first knot to secure the intermediary handle at the user-selected position.
Figure 9:
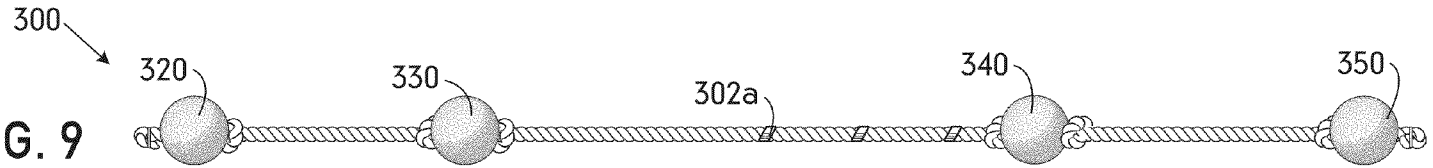
FIG. 9 a side elevational view of the exercise device, originally introduced in FIG. 6, illustrating creation of a second knot to secure the intermediary handle at the user-selected position.
Figure 10:
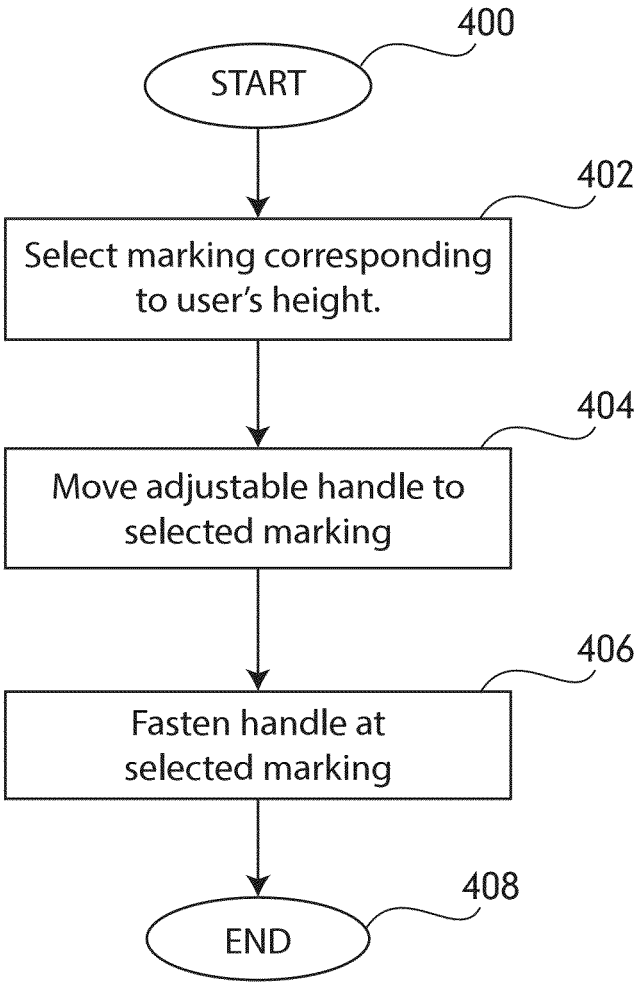
FIG. 10 is a flow diagram illustrating a process for adjusting a distance between handles of the exercise device, originally introduced in FIG. 6.

The process of FIG. 10 will now be described with reference to FIGS. 6 through 9. The exemplary process begins at step 400 and moves directly to step 402, where a user selects, on the handle adjustment chart 210, one of the plurality of markings 302 listed in the chart 210, which corresponds to the user's height. In step 404, the user moves the adjustable handle 340 in a direction A to the selected marking 302 on the substantially non-resilient cord 304, as shown by FIG. 7. In an exemplary embodiment, the user slides the adjustable handle 340 along the cord length 310 until the adjustable handle 340 is positioned at the selected marking 302. In step 406, the user fastens the handle 340 to the substantially non-resilient cord 304 at the selected position. The handle 340 can be fastened in accordance with any known fastening device and/or method, such as, for example, a clamp, clip, tie, and the like. In the exemplary embodiment, illustrated in FIGS. 8 and 9, the user fastens the handle 340 by forming a knot at opposing sides of the handle 340 to secure the handle to the selected position, as described above. The process terminates in step 408.

Figure 11:
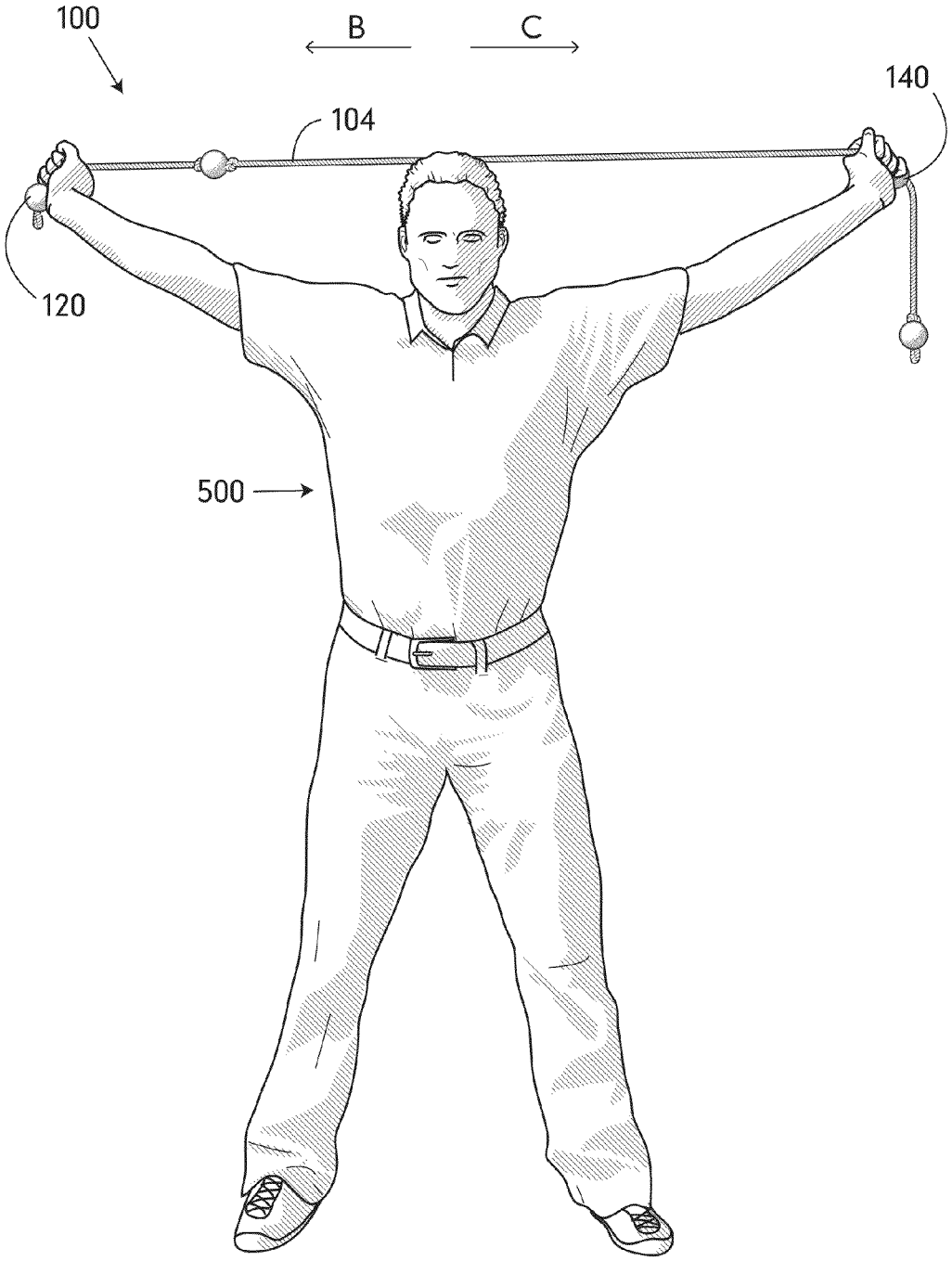
FIG. 11 is a perspective view showing a user engaging in an exemplary stretch using the exercise device of FIG. 1.

In use, the exercise device 100 can be used with a wide variety of stretching exercises. Exemplary stretching exercises will be described with reference to FIGS. 11 and 12. In FIG. 11, a user 500 is standing in an upright position. The user 500 can grasp the first end handle 120 with one hand and the second intermediate handle 140 with the other hand, lifting the exercise device 100 above his head such that his arms are in an acute angular position with respect to the ground. The user 500 can pull outwardly in opposing directions B, C and lower his arms to a more parallel position with respect to the ground until the substantially non-resilient cord 104 is taut and the desired muscular tension is achieved. The user 500 may hold this muscular stretch for at least fifteen seconds or longer, depending on the desired amount of muscular tension. The material properties of the cord 104, being pliable, yet substantially non-resilient allows the user to customize the amount of tension or resistance applied during a particular stretch at any given moment, while eliminating the risk of injury caused by bouncing, jerking, or erratic tension when using some of the prior-art devices.

Figure 12:
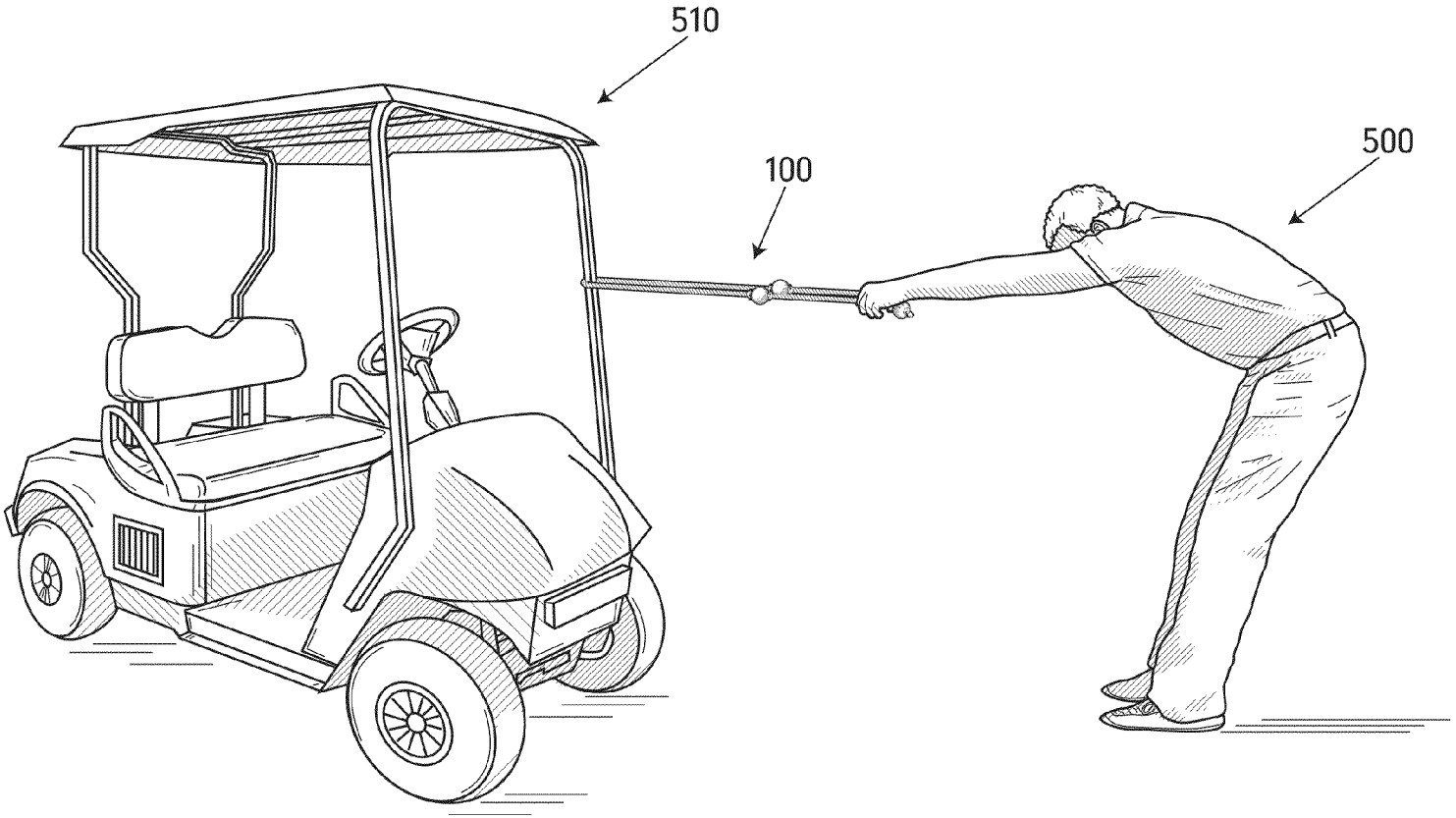
FIG. 12 is a perspective view showing the user engaging in another exemplary stretch using the exercise device of FIG. 1.

In FIG. 12, the exemplary stretching exercise is implemented using a fixed object 510, such as a pole on a golf cart. The user 500 is shown gripping the first end handle 120 and the second end handle 160 with his right and left hands, respectively. The exercise device 100 is wrapped around the pole and the user's body is bent at an angle with his arms extending forward and parallel to one another. As the user pulls on the exercise device 100, he is able to selectively shift his body weight rearward to stretch the targeted muscles. The user may hold this stretch for at least fifteen seconds or longer, depending on the desired amount of muscular tension.

The exercise devices 100, 300 provide several advantages over the current art. The pliable cord 104 allows the exercise device 100 to be compactly folded for convenient storage and portability. Accordingly, users can utilize the exercise device 100 to stretch at any location. The structure of the exercise device 100, including the plurality of handles 120, 130, 140, 150 fastened to the cord 104, provides an easily manufactured, low cost, and low maintenance tool for stretching. The substantially non-resilient material properties of the cord 104 allows the user to apply self-regulated tension and resistance during a stretch, while reducing the risk of injury caused by bouncing, jerking, or erratic tension application resulting from elastic bands. Thus, the present invention importantly promotes safe and proper stretching techniques in a low cost solution. Additionally, the exercise device 100 of the present invention provides a multitude of gripping handles, which increases the number and types of stretching exercises that can be performed with the exercise device 100. The compact ball-shaped design of the handles 120, 130, 140, 150 is ideal for gripping with the proper tension, while stretching and does not inhibit the orientation of the user's hands during the stretch. The adjustment of the location of the handles along the length of the cord 304 allows the user to customize the handle gripping surfaces according to the user's preference, such as tailoring the location of the handles to correspond with the user's height or arm span.

What is claimed is:

1. A method of performing a stretching exercise to stretch a muscle, comprising steps of:

providing an exercise device, the exercise device including:

a pliable substantially non-resilient cord having a length between a first end and a second end;

a plurality of ball shaped handles supported by the pliable substantially non-resilient cord and positioned along the length of the pliable substantially non-resilient cord, a first one of the plurality of ball-shaped handles being positioned at the first end of the cord, a second one of the plurality of ball-shaped handles being positioned at the second end of cord, and a third one of the plurality of ball-shaped handles being positioned between the first end and the second end of cord; and a plurality of handle fasteners adapted to fixedly attach the plurality of ball shaped handles to the pliable substantially non-resilient cord;

gripping with a user's hand at least one of the plurality of ball shaped handles; and while gripping the at least one of the plurality of ball shaped handles with the user's hand, applying a force to the exercise device that stretches the muscle when the exercise device, in its entirety, is disposed in an outside ambient environment relative to the user.

2. The method of performing a stretching exercise to stretch a muscle according to claim 1, further comprising:

gripping with the user's hands two of the plurality of ball shaped handles; and pulling two of the plurality of ball shaped handles in different directions.

3. The method of performing a stretching exercise to stretch a muscle according to claim 1, further comprising:

wrapping the cord around a fixed object, prior to applying the force to the exercise device.

4. An exercise device comprising:

a pliable, substantially non-resilient, cord having a length between a first end and a second end, the length defining a plurality of height distinguishing markings, the length being between approximately 60 and 85 inches and corresponding to an arm span length of a user;

a plurality of ball-shaped handles:

supported by the cord and positioned along the length of the cord, a first one of the plurality of ball-shaped handles being positioned at the first end of the cord, a second one of the plurality of ball-shaped handles being positioned at the second end of the cord, and a third one of the plurality of ball-shaped handles being slideably coupled to the cord between the first end and the second end of the cord and disposed at a location corresponding to one of the plurality of height distinguishing markings; and a plurality of handle fasteners adapted to attach the plurality of ball-shaped handles to the cord;

wherein the user can find a first height distinguishing marking and a second height distinguishing marking of the plurality of height distinguishing markings so as to move the third ball shaped handle from the first height distinguishing marking to the second height distinguishing marking during use so as to stretch a muscle at different points along a length of the muscle.

5. The exercise device according to claim 4, wherein:

a fourth one of the plurality of ball shaped handles is positioned between the first end and the second end of the cord.

6. The exercise device according to claim 4, wherein:

at least one of the plurality of handle fasteners is a knot.

7. The exercise device according to claim 4, wherein:

at least one of the plurality of handle fasteners is a clamp.

8. The exercise device according to claim 4, wherein:

each of the plurality of handle fasteners defines a through-hole that the pliable substantially non-resilient cord passes through.

9. The exercise device according to claim 8, wherein:

each of the plurality of handle fasteners is fixedly attached along the length of the pliable substantially non-resilient cord by at least one knot formed of a sufficient size to abut an opening of the through-hole, while not passing through the opening.

10. The exercise device according to claim 4, wherein:

the cord is of a rope-like material.

11. The exercise device according to claim 4, wherein:

the plurality of ball shaped handles is comprised of golf balls.

12. An exercise kit, comprising:

an exercise device including:

a pliable substantially non-resilient cord having:

a length between a first end and a second end, and a plurality of height distinguishing markings on a surface of the pliable substantially non-resilient cord;

a plurality of ball shaped handles:

supported by the cord and positioned along the length of the cord, a first one of the plurality of ball-shaped handles being positioned at the first end of the cord, a second one of the plurality of ball-shaped handles being positioned at the second end of the cord, and a third one of the plurality of ball-shaped handles being slideably coupled to the cord between the first end and the second end of the cord and disposed at a location corresponding to one of the plurality of height distinguishing markings; and a plurality of handle fasteners adapted to fixedly attach the plurality of ball shaped handles to the pliable substantially non-resilient cord; and a handle adjustment chart including a list of different user measurements along with an identification of a corresponding one of the plurality of height distinguishing markings.

13. The exercise kit according to claim 12, further comprising:

instructions for performing at least one stretching exercise with the exercise device.

14. The exercise kit according to claim 12, wherein:

the user measurements comprise at least one of different heights and different arm span lengths.

15. The exercise kit according to claim 12, wherein:

a fourth one of the plurality of ball shaped handles is positioned between the first end and the second end of the pliable substantially non-resilient cord.

16. The exercise kit according to claim 12, wherein:

at least one of the plurality of handle fasteners is a knot.

17. The exercise kit according to claim 12, wherein:

at least one of the plurality of handle fasteners is a clamp.

18. The exercise kit according to claim 12, wherein:

the length of the pliable substantially non-resilient cord is from about 60 inches to about 85 inches.

* * * * *